US006709228B2

(12) United States Patent
Stuart

(10) Patent No.: US 6,709,228 B2
(45) Date of Patent: Mar. 23, 2004

(54) VACUUM PUMPS

(75) Inventor: Martin Nicholas Stuart, Shoreham-by-Sea (GB)

(73) Assignee: The BOC Group plc, Windlesham (GB)

( * ) Notice: Subject to any disclaimer, the term of this patent is extended or adjusted under 35 U.S.C. 154(b) by 0 days.

(21) Appl. No.: 10/271,408

(22) Filed: Oct. 15, 2002

(65) Prior Publication Data

US 2003/0086784 A1 May 8, 2003

(30) Foreign Application Priority Data

Oct. 15, 2001 (GB) ..... 0124731

(51) Int. Cl.[7] ..... F04D 19/04

(52) U.S. Cl. ..... 415/90; 415/203; 415/191; 417/295

(58) Field of Search ..... 415/90, 203, 191, 415/116, 208.2, 143, 55.1; 417/295, 423.4

(56) References Cited

U.S. PATENT DOCUMENTS

| | | | |
|---|---|---|---|
| 5,707,213 A | 1/1998 | Conrad | |
| 5,733,104 A | 3/1998 | Conrad et al. | |
| 6,030,189 A | 2/2000 | Bohm et al. | |
| 6,193,461 B1 | 2/2001 | Hablanian | |
| 6,200,107 B1 * | 3/2001 | Brewster | 417/251 |
| 6,220,824 B1 * | 4/2001 | Hablanian | 417/245 |

FOREIGN PATENT DOCUMENTS

| | | |
|---|---|---|
| EP | 0 919 726 A1 | 6/1999 |
| EP | 1 085 214 A2 | 3/2001 |
| GB | 2 360 066 | 9/2001 |

OTHER PUBLICATIONS

UK Patent Office Search Report dated Apr. 8, 2002.
European Search Report of Application No. EP 02 25 7066 completed Dec. 6, 2002.

* cited by examiner

*Primary Examiner*—Edward K. Look
*Assistant Examiner*—J. M. McAleenan
(74) *Attorney, Agent, or Firm*—Ira Lee Zebrak

(57) ABSTRACT

A compound vacuum pump comprising at least one turbo-molecular stage and downstream therefrom a multi-channel molecular drag stage, a first inlet through which fluid can pass through the turbo-molecular stage and the molecular drag stage towards a pump outlet, a second inlet through which fluid can enter the pump at a location between the turbo-molecular and the molecular drag stages to pass only through the molecular drag stage towards the pump outlet, in which one or more channels of the molecular drag stage are adapted to communicate directly with the second inlet whilst the remaining channel or channels communicate with the turbo-molecular stage.

12 Claims, 6 Drawing Sheets

VACUUM PUMPS

FIELD OF THE INVENTION

This invention relates to vacuum pumps and in particular to compound vacuum pumps which employ at least one turbo-molecular stage and one molecular drag stage.

BACKGROUND OF THE INVENTION

There is described in European patent publication number 0 919 726 a vacuum pump comprising first and second turbo-molecular stages and a molecular drag (Holweck) stage. This known pump has a first inlet through which fluid being pumped passes through all the pump stages and a second inlet through which fluid enters the pump between the two turbo-molecular stages and passes only through one turbo-molecular stage and the Holweck stage. The turbo-molecular stage upstream of the second inlet is sized differently from the turbo-molecular stage downstream of the second inlet so that the vacuum pump suits the pressure requirements or pumping capacities of the chambers/systems being evacuated and attached to the first and second inlets respectively.

This known "split flow" turbo-molecular pump facilitates the differential pumping of, for example, two chambers of a scientific instrument. For example, in well known types of mass spectrometer that part of the apparatus known as the detector commonly has to be operated at, for example, $10^{-6}$ mbar whereas that part known as the analyser has to be operated at a different level of vacuum for example $10^{-3}$ mbar. The chamber requiring the lower pressure (higher vacuum) is attached to the first inlet so that the fluid being evacuated is subject to all the stages of the pump whilst the chamber requiring the higher pressure (lower vacuum) is attached to the second inlet so that the fluid being evacuated is subject only to the pump stages downstream of the second inlet.

With liquid phase mass spectrometer (MS) systems there is increasingly a demand for higher gas loads to be consumed by the vacuum system. The highest gas load handling capacity is required at the comparatively "high" pressure end of the pump. As the gas load diminishes in the subsequent chambers so to the system pressure decreases until eventually it reaches a level acceptable for analysis.

OBJECTS OF THE INVENTION

It is an aim of the present invention to provide an improved compound vacuum pump including at least one turbo-molecular stage and downstream therefrom a multi-channel molecular drag stage in which one or more channels of the molecular drag stage are devoted to pumping a high pressure fluid inlet whilst the remainder of the channels are devoted to "back" the turbo-molecular stage.

SUMMARY OF THE INVENTION

According to the present invention, a compound vacuum pump comprises at least one turbo-molecular stage and downstream therefrom a multi-channel molecular drag stage, a first inlet through which fluid can pass through the turbo-molecular stage and the molecular drag stage towards a pump outlet, a second inlet through which fluid can enter the pump at a location between the turbo-molecular and the molecular drag stages to pass only through the molecular drag stage towards the pump outlet, in which one or more channels of the molecular drag stage are adapted to communicate directly with the second inlet whilst the remaining channel or channels communicate with the turbo-molecular stage.

Preferably, the multi-channel molecular drag stage is a Holweck stage with a plurality of channels arranged as a plurality of helixes.

In one embodiment, a baffle directs one or more of the helical channels of the Holweck stage towards the second inlet.

BRIEF DESCRIPTION OF THE DRAWINGS

An embodiment of the invention will now be described, by way of example, reference being made to the Figures of the accompanying diagrammatic drawings in which.

DETAILED DESCRIPTION OF THE INVENTION

Figure 1:
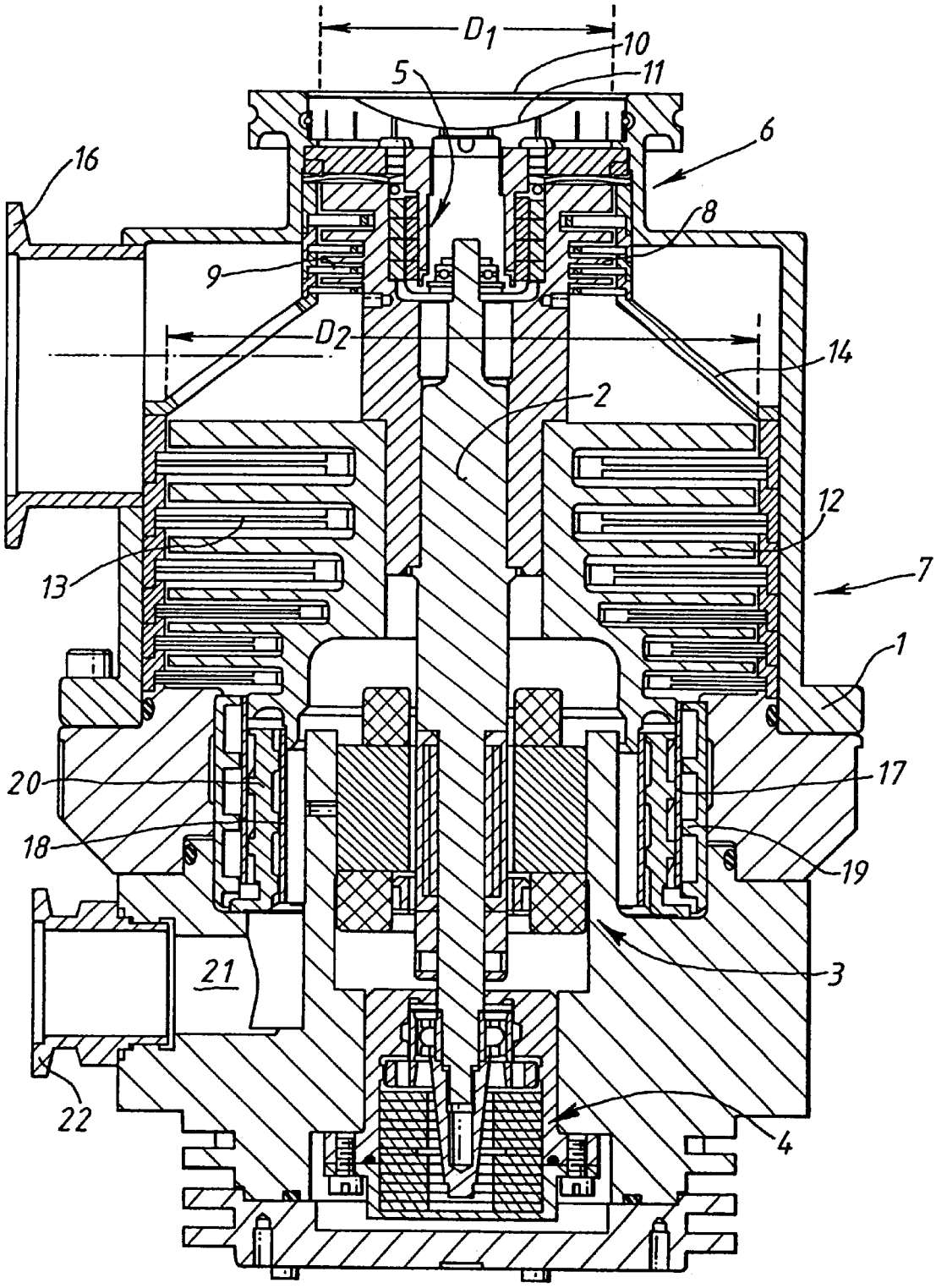
FIG. 1 is a vertical cross-section through a known compound vacuum pump employing two turbo-molecular stages, a Holweck stage, a low pressure inlet and a high pressure inlet.

Referring first to FIG. 1 there is shown a known compound vacuum pump having a multi-component body 1 within which is mounted a shaft 2. Rotation of the shaft 2 is effected by a motor 3 positioned about the shaft 2. The shaft 2 is mounted in lower and upper bearings 4, 5 respectively.

The pump includes two sets of turbo-molecular stages 6, 7. The first set of turbo-molecular stages 6 comprises four rotor and stator blade pairs of known angled construction, a rotor blade stage is indicated at 8 and a stator blade stage is indicated at 9.

The second set of turbo-molecular stages 7 comprises a further six rotor and stator blade pairs of angled construction, a rotor blade stage is indicated at 12 and a stator blade stage is indicated at 13 in the drawing.

The pump is provided with a low pressure inlet 10 and a higher pressure inlet 16.

Downstream of the turbo-molecular stage 7 are a number of Holweck stages. These Holweck stages comprise two rotating cylinders 17, 18 and corresponding annular stators 19, 20 having helical channels formed therein all in a manner known per se. Downstream of the Holweck stages is a pump outlet 22.

In this known pump, the inlet 10 is connected to a chamber/system requiring a relatively high vacuum (low pressure) and the fluid pumped through the inlet 10 passes through both the turbo stages 6, 7 and also the Holweck stages and exits the pump via the outlet 22. The inlet 16 is connected to a chamber/system requiring less vacuum (higher pressure) and the fluid pumped through the inlet 16 passes only through the turbo-molecular stages 7 and the Holweck stages and exits the pump via the outlet 22.

Figure 2:
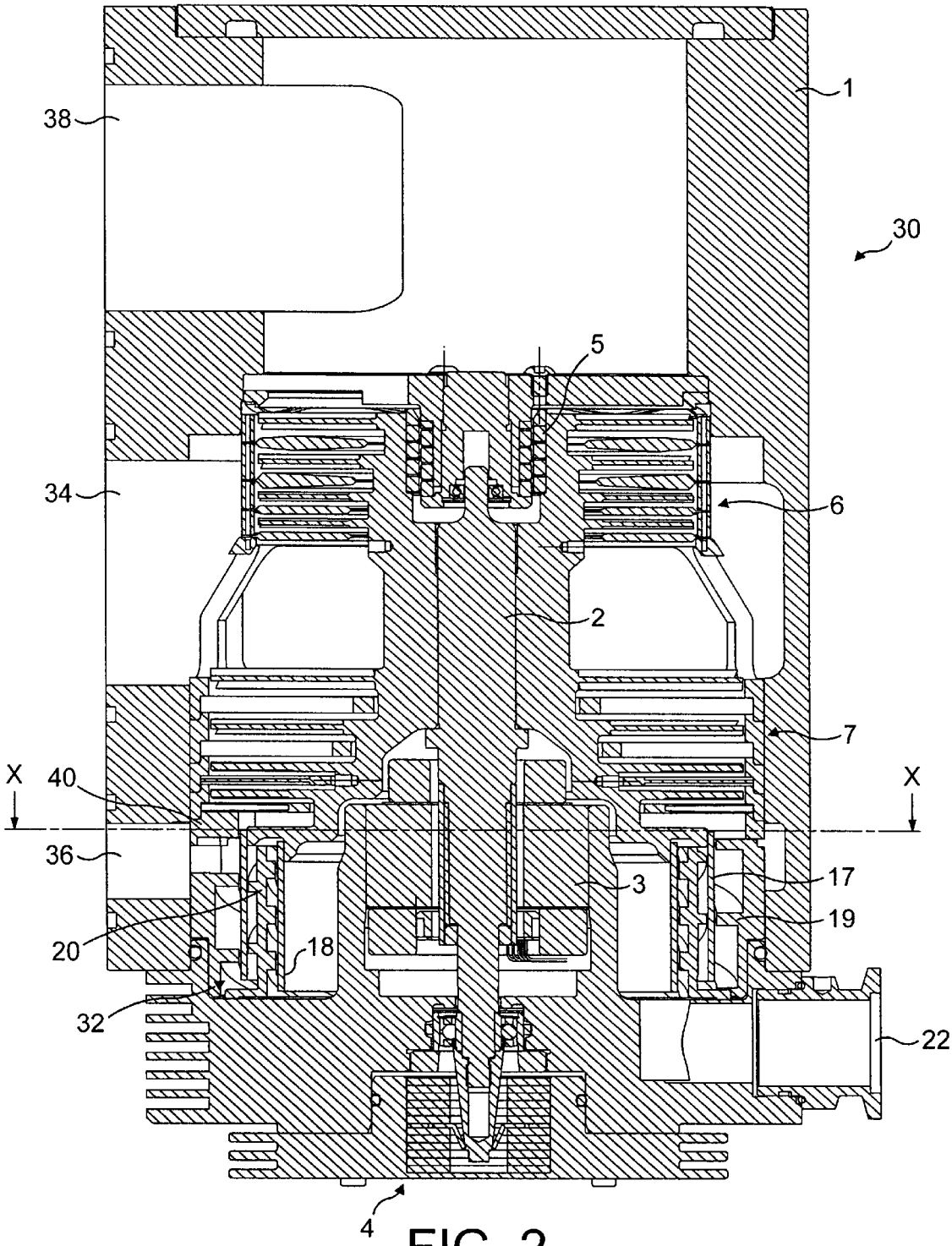
FIG. 2 is a vertical cross-section through a compound vacuum pump according to the present invention.
Figure 3:
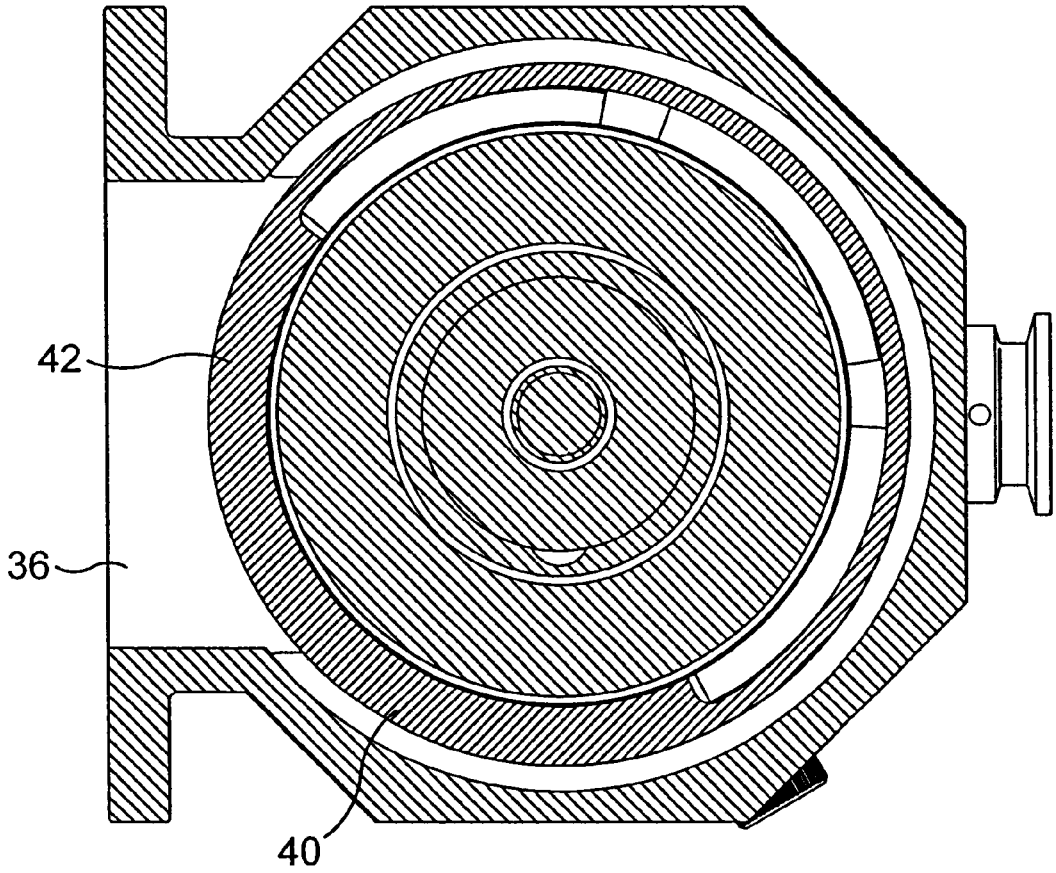
FIG. 3 is a cross section on the line X—X of FIG. 2.
Figure 4:
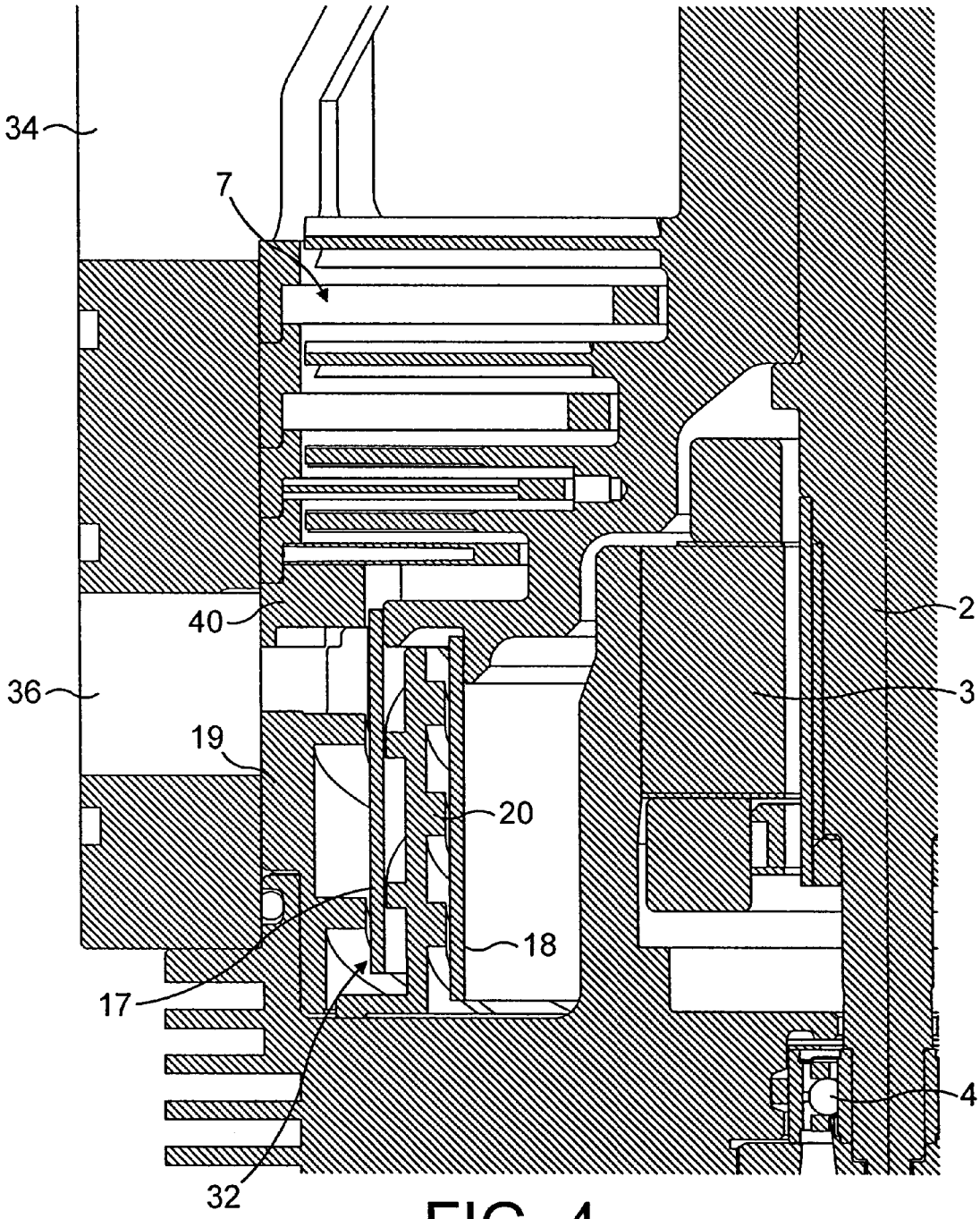
FIG. 4 is an enlarged detail of the compound vacuum pump of FIGS. 2 and 3 at a high pressure inlet interstage between a turbo-molecular stage and a Holweck stage.

Referring now to FIGS. 2 to 4 where like reference numerals denote like parts, a compound vacuum pump 30 comprises a body 1 within which is mounted a vertical shaft 2 supported by lower and upper bearings 4, 5. Rotation of the shaft 2 is effected by a motor 3.

The pump 30 has two sets of turbo-molecular stages 6, 7 and a Holweck stage 32.

The pump 30 has three inlets and an outlet 22. The first inlet 34 (mid gas pressure) is located interstage the two turbo-molecular stages 6, 7; the second inlet 36 (high gas pressure) is located interstage the turbo-molecular stage 7 and the Holweck stage 32; and the third inlet 38 (low gas pressure) is located upstream of all three stages The Holweck stage 32 includes two rotating cylinders 17, 18 and corresponding annular stators 19, 20 and helical channels formed thereon all in a manner known per se.

Figure 6:
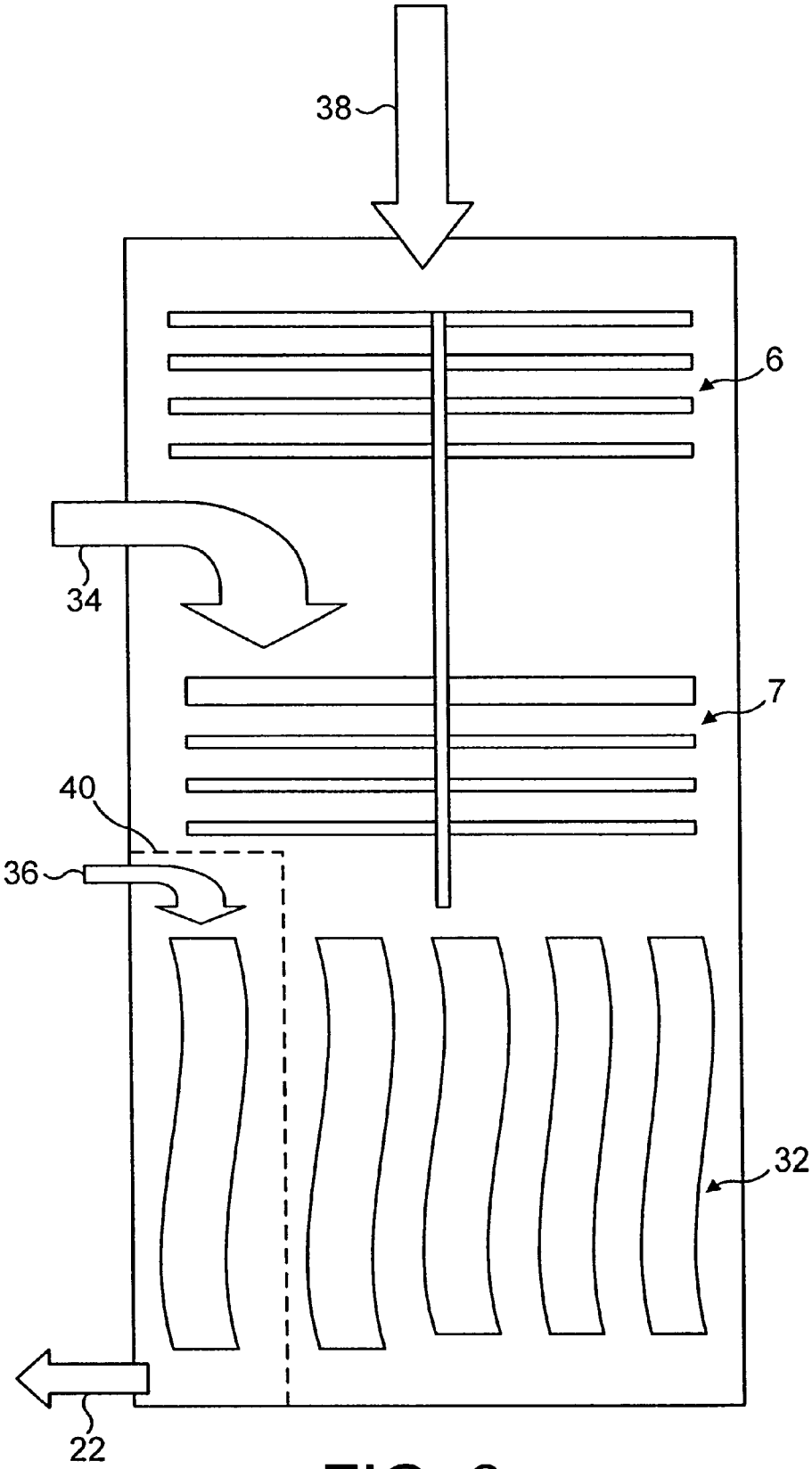
FIG. 6 is a schematic illustration of an embodiment of the invention in which a single channel of the Holweck stage is directed to communicate directly with a high pressure fluid inlet whilst the remaining four channels communicate with a turbo-molecular stage.

According to the invention, and as shown in FIG. 6, one or more channels of the Holweck stage 32 is adapted to communicate directly with the high pressure inlet 36 whilst the remaining channel or channels communicate and serve to back turbo-molecular stage 7.

Figure 5:
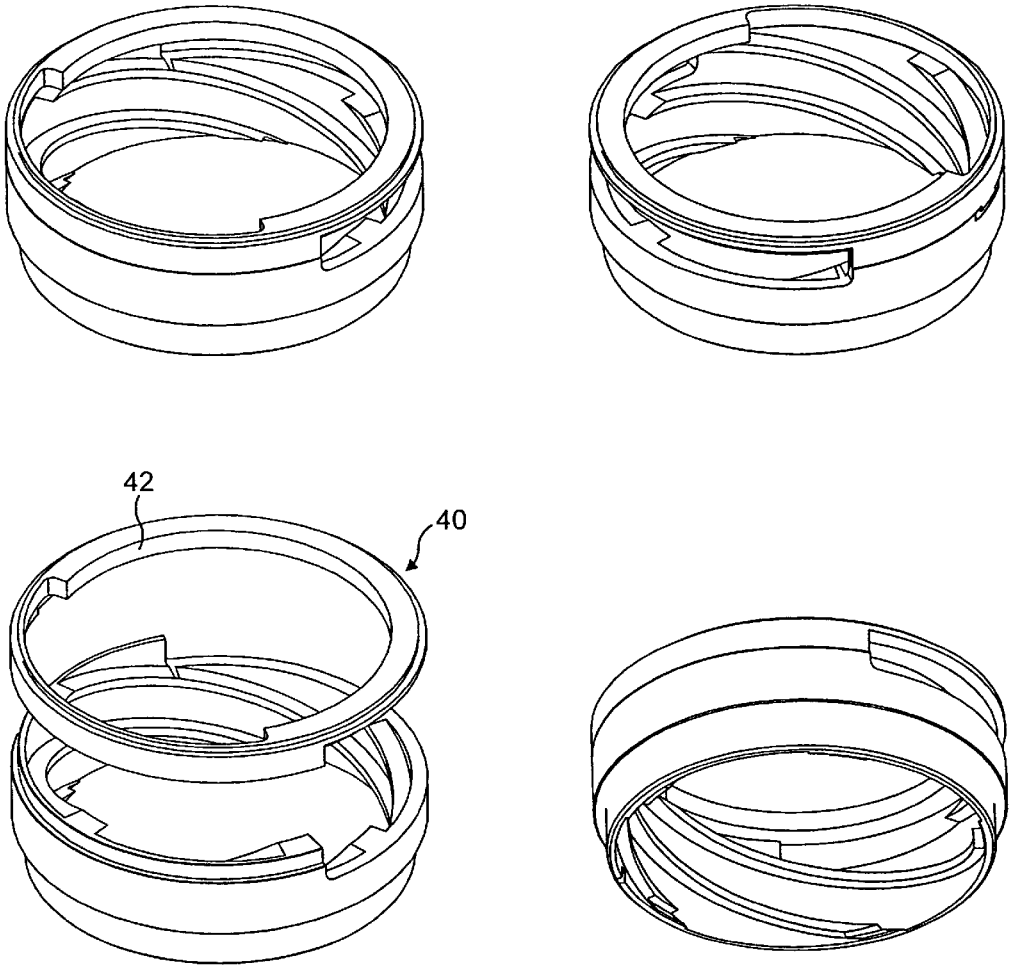
FIG. 5 is a detail in perspective of the Holweck stage and a baffle member forming part of the compound vacuum pump of FIG. 2.

Referring also to FIG. 5, the Holweck stage 32 is provided with a baffle member 40 having a radially inwardly directed flange 42 which allows only one channel (as shown) of the Holweck stage to communicate with the high pressure gas inlet 36 and prevents back streaming of the high pressure gas in to the turbo blades of the turbo-molecular stage 7.

The remaining channels of the Holweck stage are used to "back" the turbo blade stages of the turbo-molecular stage 7.

It will be apparent that the flange 42 could be extended so that more than one channel could be directed at the high pressure gas inlet 36.

A particular advantage of the embodiment described above is that the use of varying numbers of Holweck molecular drag stage channels for the purpose of either pumping the high pressure inlet or "back" the turbo blades stages 7 is matched to individual scientific instrument applications.

What is claimed is:

1. A compound vacuum pump comprising at least one turbo-molecular stage and downstream therefrom a multi-channel molecular drag stage, a first inlet through which fluid can pass through the turbo-molecular stage and the molecular drag stage towards a pump outlet, a second inlet through which fluid can enter the pump at a location between the turbo-molecular and the molecular drag stages to pass only through the molecular drag stage towards the pump outlet, in which one or more channels of the molecular drag stage are adapted to communicate directly with the second inlet whilst the remaining channel or channels communicate with the turbo-molecular stage.

2. A compound vacuum pump as claimed in claim 1 in which the multi-channel molecular drag stage is a Holweck stage with a plurality of channels arranged as a plurality of helixes.

3. A compound vacuum pump as claimed in claim 2 in which a baffle directs one or more of the helical channels of the Holweck stage towards the second inlet.

4. A compound vacuum pump as claimed in claim 3 in which at least two turbo-molecular stages are provided upstream of the Holweck stage.

5. A compound vacuum pump as claimed in claim 4 in which the pump has at least one additional inlet through which fluid will pass through both the turbo-molecular stages and the molecular drag stage towards the outlet.

6. A compound vacuum pump as claimed in claim 5 in which the baffle includes a flange for inhibiting the back streaming of fluid from the Holweck stage towards the turbo-molecular stage.

7. A compound vacuum pump as claimed in claim 4 in which the baffle includes a flange for inhibiting the back streaming of fluid from the Holweck stage towards the turbo-molecular stage.

8. A compound vacuum pump as claimed in claim 2 in which at least two turbo-molecular stages are provided upstream of the Holweck stage.

9. A compound vacuum pump as claimed in claim 8 in which the pump has at least one additional inlet through which fluid will pass through both the turbo-molecular stages and the molecular drag stage towards the outlet.

10. A compound vacuum pump as claimed in claim 9 in which the baffle includes a flange for inhibiting the back streaming of fluid from the Holweck stage towards the turbo-molecular stage.

11. A compound vacuum pump as claimed in claim 8 in which the baffle includes a flange for inhibiting the back streaming of fluid from the Holweck stage towards the turbo-molecular stage.

12. A compound vacuum pump as claimed in claim 3 in which the baffle includes a flange for inhibiting the back streaming of fluid from the Holweck stage towards the turbo-molecular stage.

* * * * *